US006397556B1

(12) United States Patent
Karpinia

(10) Patent No.: US 6,397,556 B1
(45) **Date of Patent: *Jun. 4, 2002**

(54) REINFORCED ROOF SHINGLE

(76) Inventor: Walter R. Karpinia, 11406 N. 172nd Pl., Jupiter, FL (US) 33478

( * ) Notice: Subject to any disclaimer, the term of this patent is extended or adjusted under 35 U.S.C. 154(b) by 0 days.

This patent is subject to a terminal disclaimer.

(21) Appl. No.: 09/494,707

(22) Filed: Jan. 31, 2000

Related U.S. Application Data

(63) Continuation-in-part of application No. 09/427,439, filed on Oct. 26, 1999, now Pat. No. 6,247,289.

(51) Int. Cl.[7] ..... E04G 23/00
(52) U.S. Cl. ..... 52/748.1; 52/543; 52/551
(58) Field of Search ..... 52/543, 551, 745.06, 52/746.11, 748.1, 712

(56) References Cited

U.S. PATENT DOCUMENTS 4,301,633 A * 11/1981 Neumann ..... 52/309.4
4,637,191 A * 1/1987 Smith ..... 52/522
5,181,361 A * 1/1993 Hannah et al. ..... 52/535
5,577,361 A * 11/1996 Grabek, Jr. ..... 52/543
5,615,523 A * 4/1997 Wells et al. ..... 52/98
5,666,776 A * 9/1997 Weaver et al. ..... 52/557
5,916,103 A * 6/1999 Roberts ..... 52/552
6,199,338 B1 * 3/2001 Hudson, Jr. et al. ..... 52/518

* cited by examiner

*Primary Examiner*—Carl D. Friedman
*Assistant Examiner*—Jennifer I. Thissell
(74) *Attorney, Agent, or Firm*—McHale & Slavin

(57) ABSTRACT

The present invention provides a method and a device for reinforcing and securing the roof of a building by particular placement of a plurality of shingle straps in a manner effective to provide controlled separation of parts of the shingles while maintaining an intact roof surface covering. In a particular embodiment a reinforcing strap is installed upon or formed integral with a roofing shingle of non-uniform thickness. Appropriate placement of the shingle straps results in a roof which is able to withstand extreme forces, e.g. wind speeds up to about 150 MPH, such as those encountered in a strong hurricane. The method and device may be used to retrofit existing buildings, without requiring partial or total removal of the roof.

7 Claims, 2 Drawing Sheets

REINFORCED ROOF SHINGLE

REFERENCE TO RELATED APPLICATIONS

This applications is a continuation-in-part of U.S. Ser. No. 09/427,439, filed Oct. 26, 1999 now U.S. Pat. No. 6,247,289, the contents of which is herein incorporated by reference.

FIELD OF THE INVENTION

This invention relates to the securement of a shingled roof to withstand the destructive forces of wind and/or rain, particularly to a reinforcing strap which is installed in overlying relation to the shingles, and most particularly to a roofing shingle of non-uniform thickness which contains a reinforcement strap. In a particular embodiment, once the strap is fitted or applied to a shingle, the shingle thickness uproof may be decreased from a standard thickness by up to about 50%; additionally fiber reinforcement may be oriented at about a 90° angle with respect to the strap for additional reinforcement.

BACKGROUND OF THE INVENTION

Property damage occurs on a daily basis due to extreme weather conditions such as wind gusts, hurricanes or the like weather systems that produce high winds. Such events cause the loss of personal property when a roof covering is destroyed, exposing both the building interior and its contents to the same elements that caused the loss of the roof. Numerous attempts have been made to eliminate or limit the damage to the roofs due to high winds and/or heavy rains, however, such attempts have largely proven to be unsuccessful or not commercially feasible.

For instance, it has been proposed to partially remove existing roofs to allow installation of mechanical fastening systems to provide roof reinforcement, however, such methods are extremely labor intensive and in view of the associated costs have not met with a great deal of success. Additionally, heavier gauge and/or reinforced shingles have been produced, but are also costly due to required removal and reinstallation.

A problem with conventional shingles is that strong winds are capable of generating strong uplift forces in excess of 100 lbs./sq. ft., resulting in the tearing or shearing of shingles from their underlying support members. The use of mechanical fasteners, such as nails or screws do not provide a broad enough area of resistance to withstand such forces. The heads of the fasteners tear through the shingle in random fashion resulting in shingle loss and subsequent damage to the structure. Reinforcement with glues and various adhesives and the inclusion of additional standard mechanical fasteners have helped, but fail to provide viable protection when exposed to high wind speeds including hurricane-force winds. Use of adhesive on older roofs is again costly and the required movement of a shingle for placement of adhesive can cause damage to the shingles in and of itself. During a storm, should one or more of the shingles become torn from the support members, the entire roof covering or a large portion thereof can be easily torn from the structure. The exposed interior of the building, along with its contents, are then subject to water and wind damage, resulting in extensive loss.

DESCRIPTION OF THE PRIOR ART

U.S. Pat. No. 2,161,440 is drawn to a shingle having a uniform thickness which includes a reinforcing strip integral therewith for strengthening and reinforcing the upper ends of the openings between the tabs to provide a reinforced area for nailing and to reduce the tendency of the shingles to tear at the upper ends of the openings between the tabs. This patent fails to teach a device for retrofitting an existing roof to prevent uncontrolled tearing of the shingles due to wind generated uplift.

U.S. Pat. No. 5,390,460 teaches a roof securing system utilizing an elongate strap for reinforcing the attachment of underlying sheathing members to the truss structure of the roof. The system can not be retrofit to an existing, intact roof. Furthermore, the patent does not address the problems related to shingle uplift.

U.S. Pat. No. 5,722,212 is drawn to the use of retaining clips for roof tiles. This patent focuses on retention of the lower end of a shingle to prevent the shingle from lifting and being removed by heavy winds. Such a system suffers from an inability to maintain the shingles in place during exceedingly strong winds. At some point, the force of uplift is greater than that which can be borne by the clips and the entire tile is lost.

The prior art fails to provide a method or device which augments an existing and intact roof's ability to withstand high wind exposure. Furthermore, the prior art fails to teach a shingle of nonuniform thickness, wherein substantial savings in both the cost of materials and in the overall weight of the roofing material are realized. The instant invention describes an apparatus and a method for its use which facilitates shearing off of a particular portion of a shingle(s) due to high wind exposure while maintaining the remainder of the roof covering in an intact condition thereby mitigating water and wind intrusion and their subsequent damage.

The instantly disclosed invention provides a means for reinforcing and securing the shingles of a building against uplift forces such as those encountered in hurricanes, and particularly describes a method and device useful in the retrofitting of existing building structures so as to provide for a controlled tearing at a predetermined location, thereby satisfying a long felt need in the art. In a particularly preferred embodiment, the reinforcing strap added to or formed integral with a shingle constructed so as to have a first thickness adjacent one lengthwise edge of the reinforcing strap and a second thickness adjacent the opposite lengthwise edge, thereby defining a shingle having a nonuniform thickness. In addition, fiber reinforcement, which in prior art shingles is randomly applied, is herein applied so that the fibers are oriented at about a 90° angle with respect to the strap lengthwise edge. These improvements in shingle design provide for substantial increases in reinforcement and securement of the roof structure while simultaneously reducing both the overall weight and cost.

SUMMARY OF THE INVENTION

The invention teaches a method and a device for reinforcing and securing the shingles on a roof by particular placement of straps over individual shingles in a manner effective to provide controlled separation of shingles while maintaining overall roof integrity. The disclosed placement of the shingle straps allows a roof structure to withstand extreme wind forces, such as those encountered in a hurricane. The method and device may be used to retrofit existing buildings, without requiring partial or total removal of the roof. The invention further teaches an improved shingle design which results in substantial improvements in both reinforcement and securement of the roof structure while simultaneously reducing the overall weight and cost.

The present invention relates generally to an improved roofing system; and more particularly, to the use of shingle straps as an adjunct device overlying existing roofing shingles or alternatively overlying or formed integral with a roofing shingle having a nonuniform thickness to provide roof reinforcement which exhibits superior strength and durability characteristics for extended periods of time, e.g., in order to withstand high wind events.

The invention is for use with most every type of shingle now in use. Such shingles are exemplified by, but not limited to, shingles made with a substrate of either organic fiber saturated with asphalt or chopped glass fiber with a urea-formaldehyde binder. For example, a typical shingle consists of a substrate first coated with a mixture of asphalt and fillers such as limestone, sand or stone dust. The coated substrate then is covered with colored granules to give aesthetic appeal to the front of the shingles. In some instances, a parting agent may be applied to the back of the substrate so that the packaged shingles do not stick together. Additionally, an asphalt sealant may be placed on the granulated side of the shingles to enhance adhesion to the back of covering shingles in the final applied configuration. Although shingles manufactured in this manner are affordable and generally perform well in a wide variety of applications, such shingles will not withstand extreme weather conditions and are characteristic of one of the weakest types of shingles. The instant invention operates independently of the particular shingle, despite its own structural strength, providing universal applicability to a wide range of roofing situations. In those embodiments where the strap is not a part of the shingle, the instant method may strategically position the strap to aid in controlling shearing of the shingle free end at a desired location. In those embodiments where the strap is formed integral with the shingle, the shingle may be engineered to be of a nonuniform thickness. This design enables shearing of the shingle free end, as described above, while the remaining shingle material provides an intact, albeit thinner, roof surface. The tabs may be secured to prevent failure by inclusion of oriented fibers as previously described. Since the thinner area is only exposed subsequent to the occurrence of catastrophic weather conditions, the overall longevity of the roof is unaffected, while initial cost and overall weight are substantially reduced.

The most recognized tests used by industry to quantify the performance of roof structures, and shingled roofs especially, are those conducted by Underwriters Laboratories (UL). The UL tests include fire resistance and wind resistance up to 60 mph.

Additionally, the American Society for Testing and Materials (ASTM) has testing requirements for both organic and fiberglass shingles. However, these standards relate mainly to the raw materials used in shingles, or to limited performance characteristics of the finished product. With regard to organic shingles, for example, there are no requirements for physical performance except that events like shingle cracking or sticking together be avoided. See ASTM Standard D-225. With reference to fiberglass-based shingles, the ASTM standards include performance requirements as to fire resistance, wind resistance, fastener pull-through and tear strength. See ASTM Standard D-3462. There is no ASTM requirement as to tensile strength.

The ultimate reliability of shingled roofs when exposed to adverse and extreme weather conditions has come under close scrutiny, with attention being paid to shingle performance during high wind events. Despite manufacturer claims that their products meet the requirements of D-3462, testing and experience in fact showed that many shingles do not pass on a consistent basis, resulting in pressure from insurance companies and municipalities for changes in building code requirements to mitigate the possible destructive nature of severe and catastrophic weather.

In view of the ancillary damage caused by Hurricane Andrew in South Florida, shingle roof coverings are now required to conform to a specific set of product quality standards in Florida. The standards provide the baseline that manufacturers now must follow in order to be able to sell product for use in Florida by requiring roof surface coverings to conform to the design wind speed of the structure to which they are applied.

Adoption of similar requirements will be forthcoming in nearby areas and will include: (1) conformance to ASTM D-3462, which must be certified by UL or another approved independent testing agency; (2) passage of the UL wind test modified to 110 mph winds; and (3) passage of a wind-driven rain test. This invention has been tested in accordance with the new guidelines and has passed at 150 mph in rain.

While many shingle manufacturers have attempted to meet Florida guidelines by modifying the construction of their products, e.g. adding to the basis weight of the chop-strand fiberglass substrate by increasing the amount of filled coating that covers the substrate, using greater amounts of coating materials, or modifying coating materials with additional fillers. These changes fail to maintain the necessary performance characteristics over time, and do not address improving existing roofing structures, short of total replacement, thereby resulting in a costly product.

Accordingly, it is an objective of the instant invention to provide an apparatus and method of reinforcing or retrofitting the shingled roof of a building to withstand the destructive forces of high winds.

It is a further objective of the instant invention to teach a reinforcing shingle strap which may be installed in overlying relation to the shingles and concealed by successive overlapping free ends.

It is yet an additional objective of the instant invention to provide a method and means for controlled tearing of shingles at known locations while maintaining structural integrity.

It is still an additional objective of the instant invention to provide a roof surface covering which remains intact when subjected to wind speeds of up to 150 MPH in driven rain.

It is a further objective of the instant invention to provide a roofing shingle having improved cost effectiveness and reduced weight by forming said shingle to have a nonuniform cross-sectional thickness.

It is yet an additional objective of the instant invention to provide a shingle with reduced tab loss by including oriented fibers therein.

These and other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
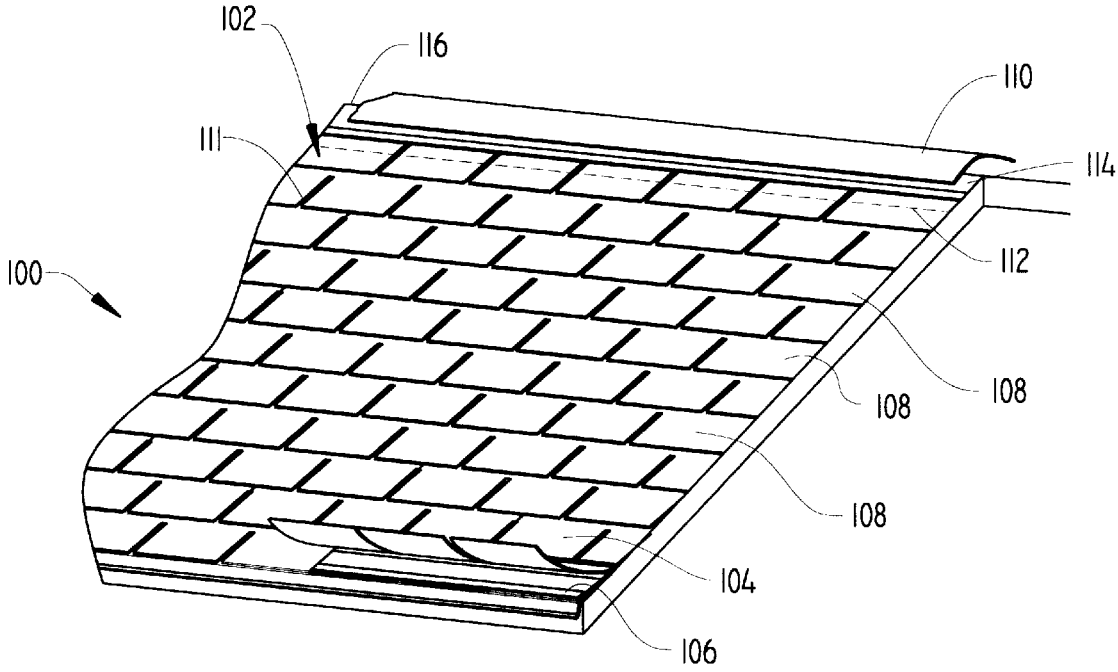
FIG. 1 is a perspective view of a shingled roof incorporating the shingle straps of the instant invention.

FIG. 1 shows a perspective view of a roof structure 100 having a plurality of tabbed shingles 102 in overlapping relation. The shingles are laid in consecutive overlapping courses. The initial or starter course 104, from which the tabs have been removed, is attached at the lowermost portion of the roof structure, and reinforcing shingle straps 106 are applied along their leading edge. The shingle straps are constructed and arranged to be of a length sufficient to span the shingles width, and of a width and a thickness sufficient to provide the required degree of reinforcement. Illustrative of a typical shingle reinforcement strap is a device having a length of about 36", a width of about 1" and a thickness effective to provide sufficient stiffness to cause the shingles to tear along the edge of the strap. In one embodiment a 26 gauge aluminum strap is used. In a particular embodiment, the reinforcement strap may contain a plurality of perforations for ease of application and positioning of fastening devices, for example nails or screws or the like. Typical materials of construction for strap 106 are selected from aluminum, galvanized steel, plastic, and the like materials having physical properties effective to reinforce the shingles in an amount sufficient to provide a strap edge which is sufficiently stiff to cause the shingles to tear along the edge of the strap. Additional shingle courses 108 progress upwardly in overlapping relation culminating along the ridge portion 110. Shingle straps 106 are applied along the nailing region 112 of courses 108, just above the tabs 111. This overlapping relationship conceals the straps 106 below free ends of successive courses. A termination course 114, which has been modified by removal of the tab portions, is applied at the ridge in overlapping relationship to the ridge axis 116. Straps 106 are applied along both the upper and lower edges of the termination course, and cap shingles are applied thereover to conceal the straps. Optionally, the ridge may include an approved standard ridge vent (not shown) which is not a part of the present invention.

Figure 2:
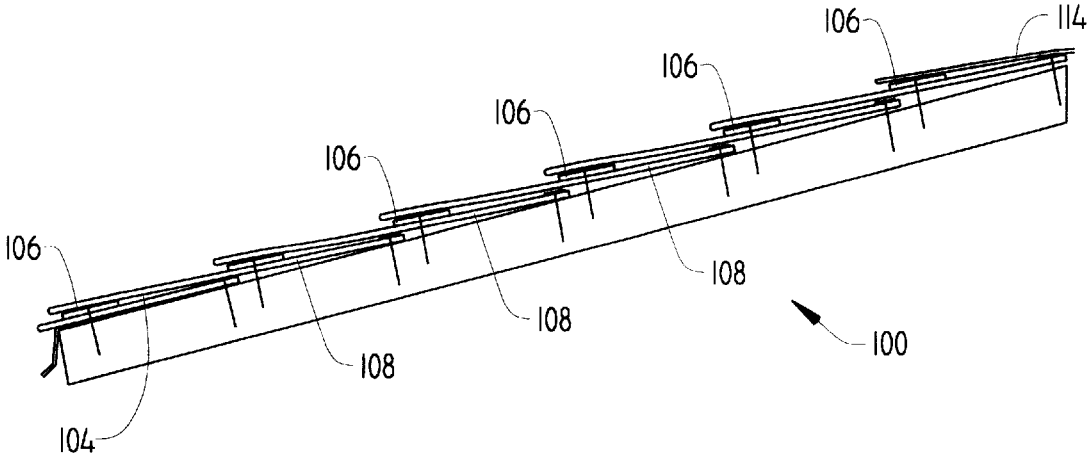
FIG. 2 is a cross-sectional view showing the intersection of courses of shingles and nominal placement of the shingle straps.

Referring to FIG. 2, a cross-sectional view of roof structure 100 is illustrated. The overlapping courses of shingles 104, 108 and 114 are depicted and placement of shingle straps 106 in relation to each particular course is further illustrated.

Figure 3:
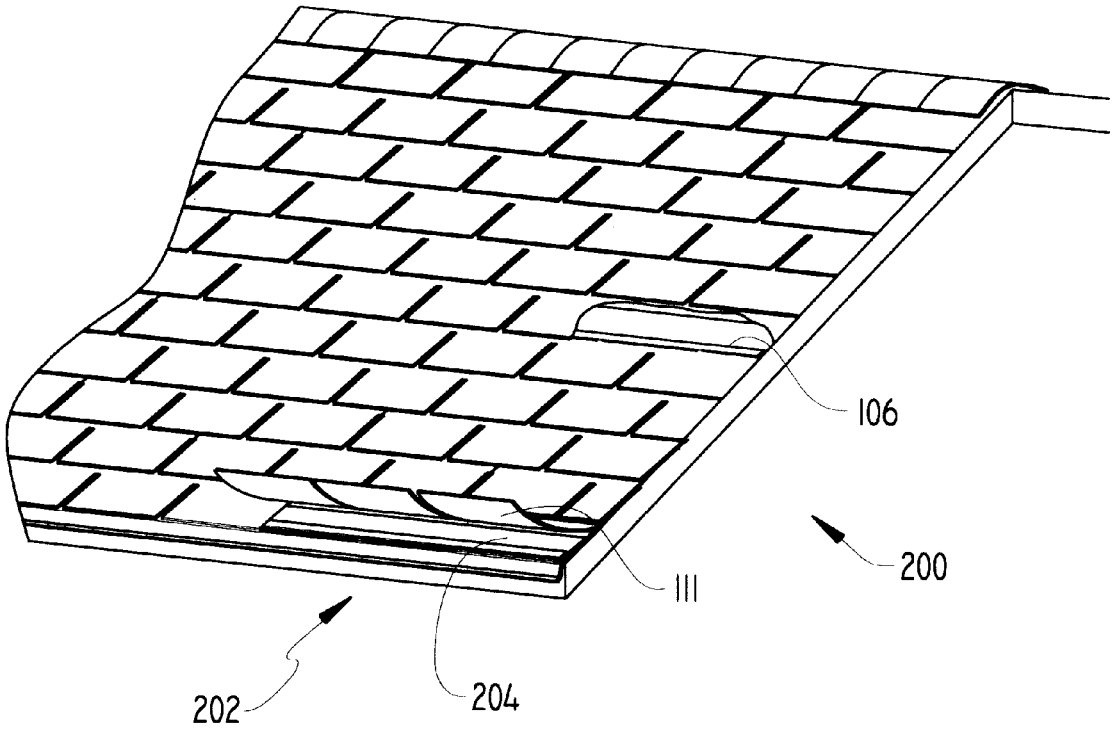
FIG. 3 is a perspective view of a roof showing wind-related tearing of the shingles in relation to the shingle straps.

Now referring to FIG. 3, a perspective view of a roof structure 200 which is sustaining ongoing damage from a high wind event is further illustrated. The wind, whose direction is illustrated via arrow 202, flows over the shingled surface with a velocity sufficient to create an uplifting force. As illustrated at 204, tabs 111 are lifted up to their point of intersection with strap 106. After repetitive cycles in which the shingle tabs 111 are lifted, they will eventually tear off along a line demarcated by the overlying straps 106. This controlled tearing of the tabs will leave the remainder of the shingles firmly attached to the underlying structure maintaining an intact and weather impervious surface at wind speeds of up to about 150 mph along with wind driven rain.

Figure 4:
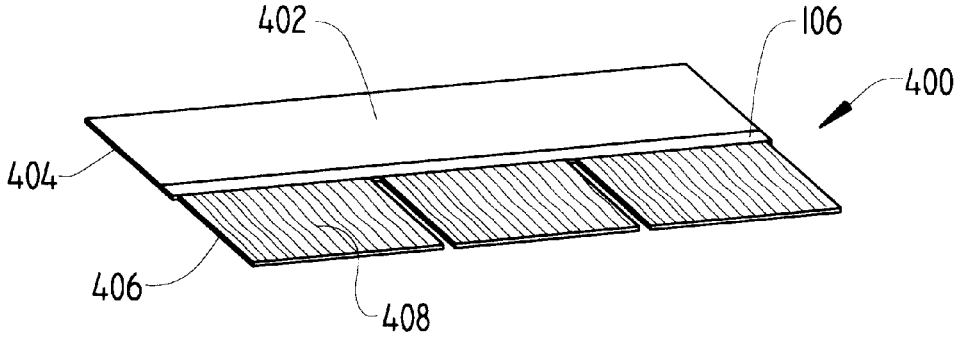
FIG. 4 is a cross-sectional view of a shingle of non-uniform thickness in conjunction with a shingle reinforcing strap.

With reference to FIG. 4, a cross sectional view of a shingle 402 is shown. The shingle is divided into two regions, a thinned region 404 and a normal thickness region 406. A reinforcing shingle strap 106 may be separate and distinct from the shingle, per se, or it may be formed integral with the shingle 402 so as to form a reinforced shingle assembly 400. A plurality of shingle assemblies are utilized to form a protective roof covering in accordance with the method as instantly taught herein. During the occurrence of a catastrophic weather condition, for example a hurricane, the normal thickness region 406, which is positioned downslope on the roof structure, will break away along a region demarcated by the reinforced shingle strap 106, leaving the thinned region 404 intact to protect the roof. This construction results in about a 33% reduction in weight and material costs. In a particular embodiment, the shingle may optionally include a plurality of reinforcing fibers 408 which are oriented at an angle of approximately 90° with respect to the lengthwise edge of the reinforcing strap.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A process for reinforcing a shingled covering of an underlying roof structure, said shingled covering formed from shingles of nonuniform cross-sectional thickness having a first region possessing a standard thickness and a second region possessing a less than standard thickness, said process comprising:

removing tabs from an initial course of tab containing shingles;

positioning said initial course of shingles upon a lowermost portion of said underlying roof structure;

fastening reinforcing shingle straps along said initial course of shingles leading edge wherein said shingles and straps are affixed to said roof structure;

positioning a plurality of additional and successive courses of tab containing shingles upon said underlying roof structure in overlapping relation and progressing in an upward direction culminating along an upper ridge portion of said underlying roof structure;

fastening reinforcing shingle straps along a nailing region of each of said additional and successive courses, said overlapping relationship of said successive courses of tab containing shingles being effective to conceal said reinforcing shingle straps below said tabs, wherein said shingles and straps are affixed to said roof structure;

removing tabs from a termination course of tab containing shingles;

positioning said termination course of shingles at said upper ridge of said roof structure in overlapping relation; and fastening reinforcing shingle straps along both edges of said termination course of shingles wherein said shingles and straps are affixed to said roof structure;

wherein upon said roof being subjected to wind of sufficient magnitude said tabs detach from said shingles along a region demarcated by said reinforcing shingle straps.

2. The process for reinforcing a shingled roof covering of an underlying roof structure in accordance with claim 1, wherein said reinforcing shingle straps are constructed and arranged to be of a length sufficient to at least span said shingles width, and a width and thickness sufficient to provide a degree of reinforcement effective to cause the shingles to tear along the edge of said straps.

3. The process for reinforcing a shingled covering of an underlying roof structure in accordance with claim 1 wherein said shingle reinforcement strap is manufactured from a material selected from the group consisting of aluminum, galvanized steel and plastic.

4. The process for reinforcing a shingled covering of an underlying roof structure in accordance with claim 1 wherein said reinforcing shingle straps are effective to provide a controlled separation of said tabs at wind speeds of up to about 150 mph.

5. The process for reinforcing a shingled covering of an underlying roof structure in accordance with claim 1, further including:

adding to said shingled covering, a plurality of reinforcing fibers oriented at an angle of about 90° with respect to a lengthwise edge of said reinforcing shingle strap;

wherein said shingled covering exhibits an increased resistance to tearing.

6. A reinforced shingle for covering an underlying roof structure comprising:

a shingle of nonuniform cross-sectional thickness having a first region possessing a standard thickness and a second region possessing a less than standard thickness;

a reinforcing shingle strap constructed and arranged to be of a length sufficient to span a width of at least one shingle, and a width and thickness sufficient to provide an effective degree of reinforcement to cause the shingled covering to tear along an edge of said strap when said at least one shingle and strap are affixed to said roof structure, said strap overlying the intersection of said regions of standard and less than standard thickness; and wherein upon said roof structure being subjected to wind of sufficient magnitude tabs detach from said shingles along a region demarcated by said reinforcing shingle straps.

7. A reinforced shingle for covering an underlying roof structure in accordance with claim 6, said shingle containing a plurality of reinforcing fibers oriented at an angle of about 90° with respect to a lengthwise edge of said reinforcing shingle strap.

* * * * *